United States Patent [19]

Ayers

[11] Patent Number: 4,489,665

[45] Date of Patent: Dec. 25, 1984

[54] MOBILE, SORBENT-PAD DISPOSAL SYSTEM

[75] Inventor: William M. Ayers, Duncan, Okla.

[73] Assignee: Halliburton Company, Duncan, Okla.

[21] Appl. No.: 590,119

[22] Filed: Mar. 16, 1984

[51] Int. Cl.[3] ..... F23G 5/12; F23G 5/02

[52] U.S. Cl. ..... 110/250; 110/220; 110/221; 110/240

[58] Field of Search ..... 110/218, 219, 220, 221, 110/223, 235, 236, 240, 241, 250

[56] References Cited

U.S. PATENT DOCUMENTS

| | | | |
|---|---|---|---|
| 2,213,668 | 9/1940 | Dundas et al. | 110/220 |
| 2,985,120 | 5/1961 | Brandt et al. | 110/240 |
| 3,287,819 | 11/1966 | Hazzard | 110/221 |
| 3,622,508 | 11/1971 | Komline | 110/221 |
| 3,826,208 | 7/1974 | Williams | 110/220 |
| 3,841,851 | 10/1974 | Kaiser | 110/220 |
| 3,938,450 | 2/1976 | Jaronko et al. | 110/240 |
| 4,121,524 | 10/1978 | Voelskow et al. | 110/220 |
| 4,290,269 | 9/1981 | Hedstrom et al. | 110/221 |

*Primary Examiner*—Henry C. Yuen

*Attorney, Agent, or Firm*—James R. Duzan; Thomas R. Weaver

[57] ABSTRACT

A movable incineration system for the disposal of used sorbent pads utilized in the cleanup of oil or hydrocarbon spills in marine environments. The portable incineration system of the present invention comprises an incinerator, a wringer, an auxiliary power skid unit, a generator and an air compressor.

3 Claims, 10 Drawing Figures

MOBILE, SORBENT-PAD DISPOSAL SYSTEM

BACKGROUND OF THE INVENTION

This invention relates to a portable incineration system for the disposal of absorbent or adsorbent pads, herein called 'sorbent', used in the cleanup of oil and hydrocarbon spills in marine environments.

Typically, sorbent pads, often made from porous, fiberous polyethylene, polypropylene, polyurethane, etc., sheets are used in the cleanup of oil and hydrocarbon spills from beaches, harbors, marshes, marinas, etc., in marine environments. After use, it is necessary to dispose of the sorbent pads. The disposal of the sorbent pads can be difficult at times since large numbers of pads are involved, since land fills or sanitary dumps may not accept the pads for disposal, and since municipal sanitary waste incineration systems may not accept the pads for incineration due to the high energy content of the used pads upsetting the normal heat load or emission aspects of the process.

Since it is not economically and environmentally feasible to create land fills at oil or hydrocarbon spill sites, and since sanitary waste incineration systems may not accept the used sorbent pads for disposal, it became necessary to develop a movable incineration system capable of meeting existing emission standards for the disposal of the used sorbent pads. A certain amount of trash typically found associated with used pads can be disposed of also in the incineration system.

STATEMENT OF THE INVENTION

The present invention is directed to a movable incineration system for the disposal of used sorbent pads utilized in the cleanup of oil or hydrocarbon spills in marine environments. The portable incineration system of the present invention comprises an incinerator, a wringer, an auxiliary power skid unit, a generator and an air compressor.

DESCRIPTION OF THE INVENTION

Figure 1:
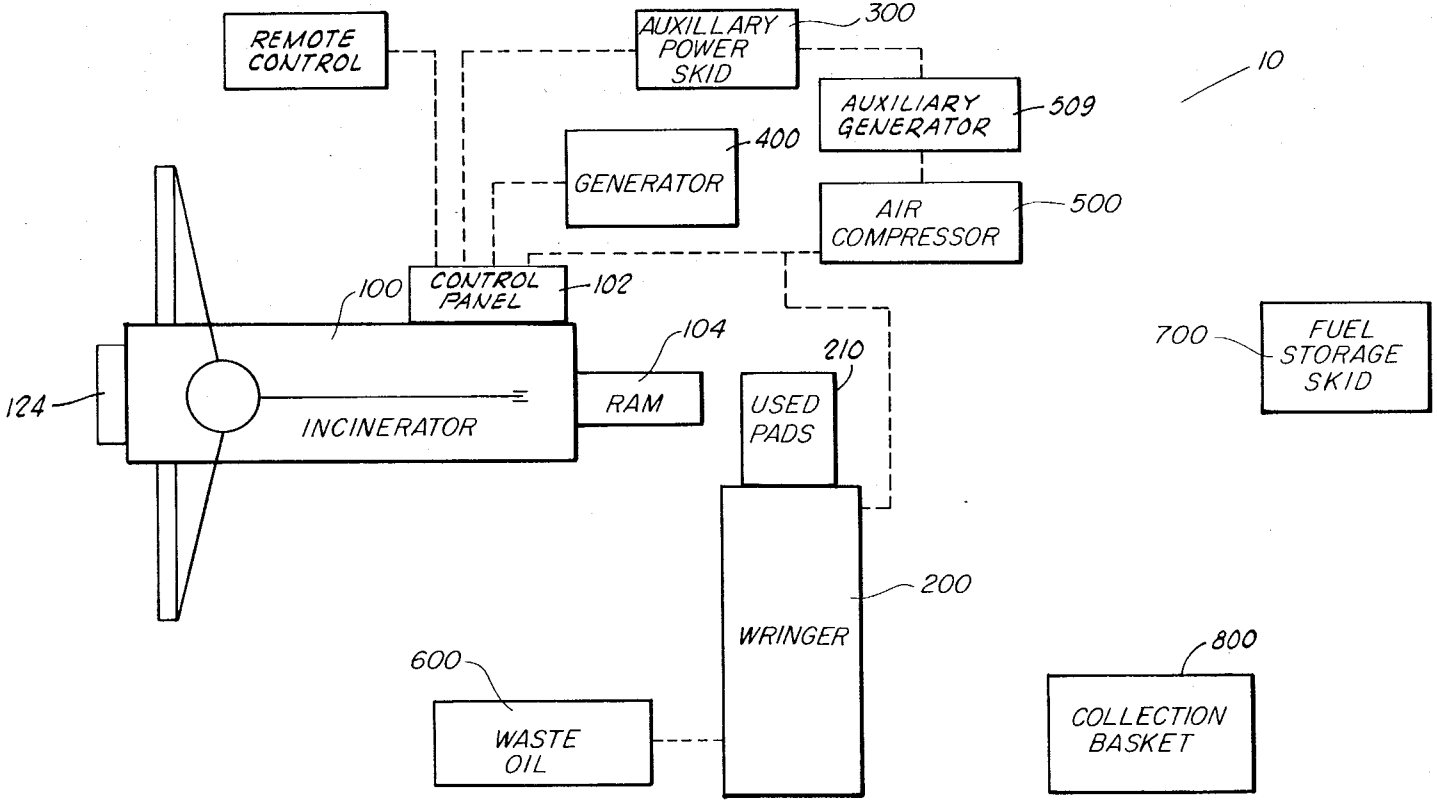
FIG. 1 is a schematic drawing of the various components of the present invention.

Referring to FIG. 1, the incinerator system 10 of the present invention is shown in its preferred embodiment.

The incinerator system 10 of the present invention comprises an incinerator 100 having a control panel 102 and ram feeding means 104 thereon, wringer 200, auxiliary power skid 300, generator 400, and air compressor 500. The incinerator system further includes a waste oil or hydrocarbon collection tank 600, a fuel storage skid 700, and pad storage collection basket 800.

Figure 2:
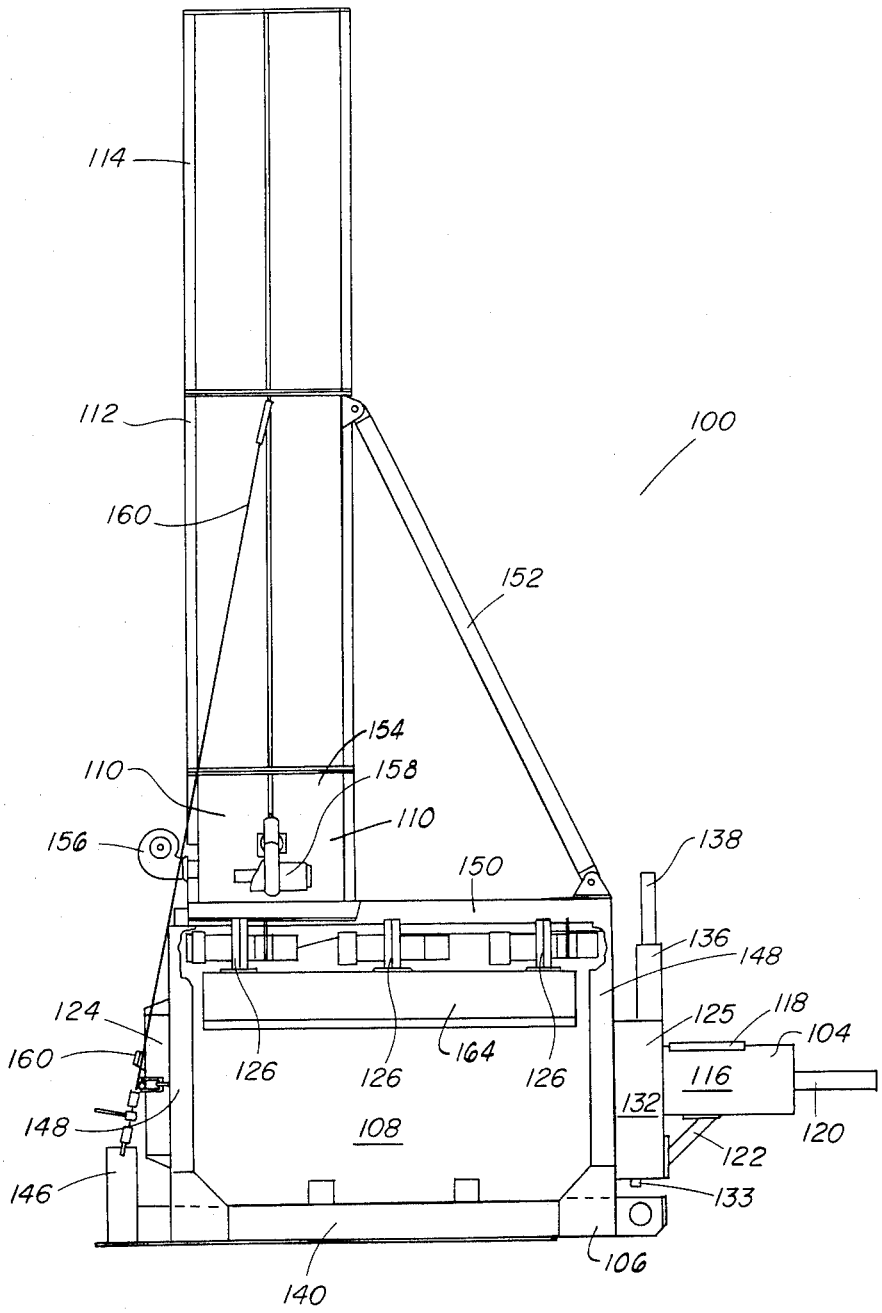
FIG. 2 is a left side view of the incinerator of the present invention with the required control panel located on the back side for clarity.

Referring to FIG. 2, the incinerator 100 of the present invention is shown having the control panel 102 deleted therefrom for clarity. The incinerator 100 comprises ram type feeder 104, rectangular frame 106, primary combustion chamber 108, reactor section 110, exhaust stack 112 and exhaust stack 114. Except for the ram type feeder 104, the additional safety features imparted through the auxiliary skid and control panel and umbilical wiring, the blower and burner operations, the control sequence of operation and the exhaust stack monitoring arrangements, the incinerator 100 is substantially the same as the model CAM-500 incinerator available from the Vento-O-Matic Incinerator Corporation of North Quincy, Mass.

The ram type feeder 104 comprises chamber or hopper 116 having a door 118 opening thereinto and having ram assembly 120 secured to one end thereof. The ram type feeder 104 is secured to one end of the primary combustion chamber 108 having reinforcing means 122 secured thereto.

The primary combustion chamber 108 comprises a generally cylindrically shaped combustion chamber which is lined with refractory material having ram type feeder 104 secured to one end thereof by means of movable door assembly 125, having access door 124 on the other end thereof, and having a plurality of combustion air blowers 126 along one side thereof, one or more main oil fired burners 128 (see FIG. 3) along the other side thereof, and a pilot burner 130 (see FIG. 3) installed along one side thereof. The movable door assembly 125 generally comprises a circulating air cooled rectangular box-like lower housing 132 having guide means therein for door 134 (see FIG. 4) therein controlling the entry to the primary combustion chamber 108, air cooled rectangular box-like upper housing 136 which receives the door 134 therein when door 134 is in its raised position and pneumatic cylinder means 138 secured to the upper housing 136 having the cylinder rod 140 (see FIG. 4) connected to door 134 to actuate the same between its open and closed position. In case of malfunction, the ram is automatically inoperable and a negative pressure from combustion operations is maintained inside the chamber 108 for flame control.

The rectangular frame 106 comprises longitudinal skid members 140, cross member 142 (see FIG. 3), horizontal stack outrigger 144 having adjustable vertical end posts 146 for leveling thereon, vertical members 148, horizontal top frame members 150 and stack support 152 (see FIG. 2).

The reactor section 110 comprises a generally cylindrical annular housing 154 lined with refractory material therein having a plurality of oil fired burners 158 and combustion air blower 156 thereon. The oil fired burners 158 are located approximately 180° apart in the reactor section 110 while the combustion air blower 156 is located 90° with respect to an adjacent oil fired burner 158.

The refractory lined exhaust stacks 112 and 114 comprise generally cylindrical shaped annular members. The exhaust stack 112 has one end secured to the outlet of the reactor section 110 and the other end secured to the inlet of exhaust stack 114. Flexible anchor means 160 are secured to the exhaust stacks 112 and 114 to secure the same in position while stack support 152 further provides necessary lateral support to the reactor section 110 and exhaust stacks 112 and 114. A third stack section could be added on some other unit.

Any suitable oil fired burner 128 or 158, and combustion air blowers 126 or 156 may be utilized in the primary combustion chamber 108 and reactor section 110 depending upon the desired incineration capacity and combustion characteristics of the primary combustion chamber 108 and reactor section 110.

Figure 3:
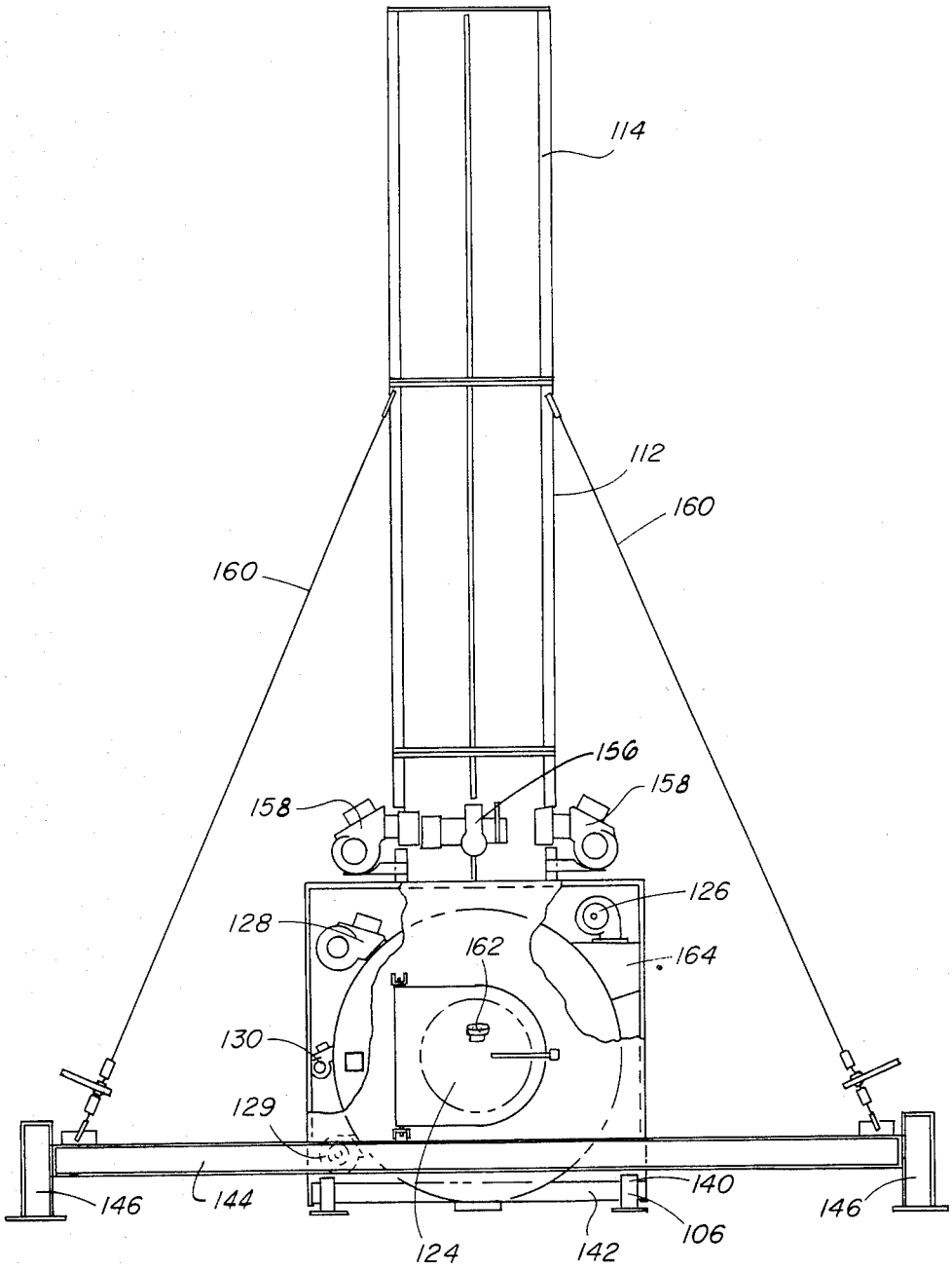
FIG. 3 is an end view of the incinerator of the present invention.

Referring to FIG. 3, one end of the incinerator 100 of the present invention is shown having control panel 102 deleted from the incinerator for clarity. The access door 124 of the incinerator 100 includes a view port 162 therein to allow viewing of the combustion process within the incinerator 100.

Oil fired burners 128 and pilot burner 130 are located on one side of the incinerator 100 while air blowers 126 are located on the other side of the incinerator being mounted on plenum chamber 164.

As shown, the flexible anchor means 160 have one end secured to the exhaust stacks 112 and 114 while the other end thereof is secured adjacent the end of horizontal stack outrigger 144 having vertical end posts 146 thereon. Adjustments can be made to facilitate barge mounting, ground level, etc., with posts 146.

Figure 4:
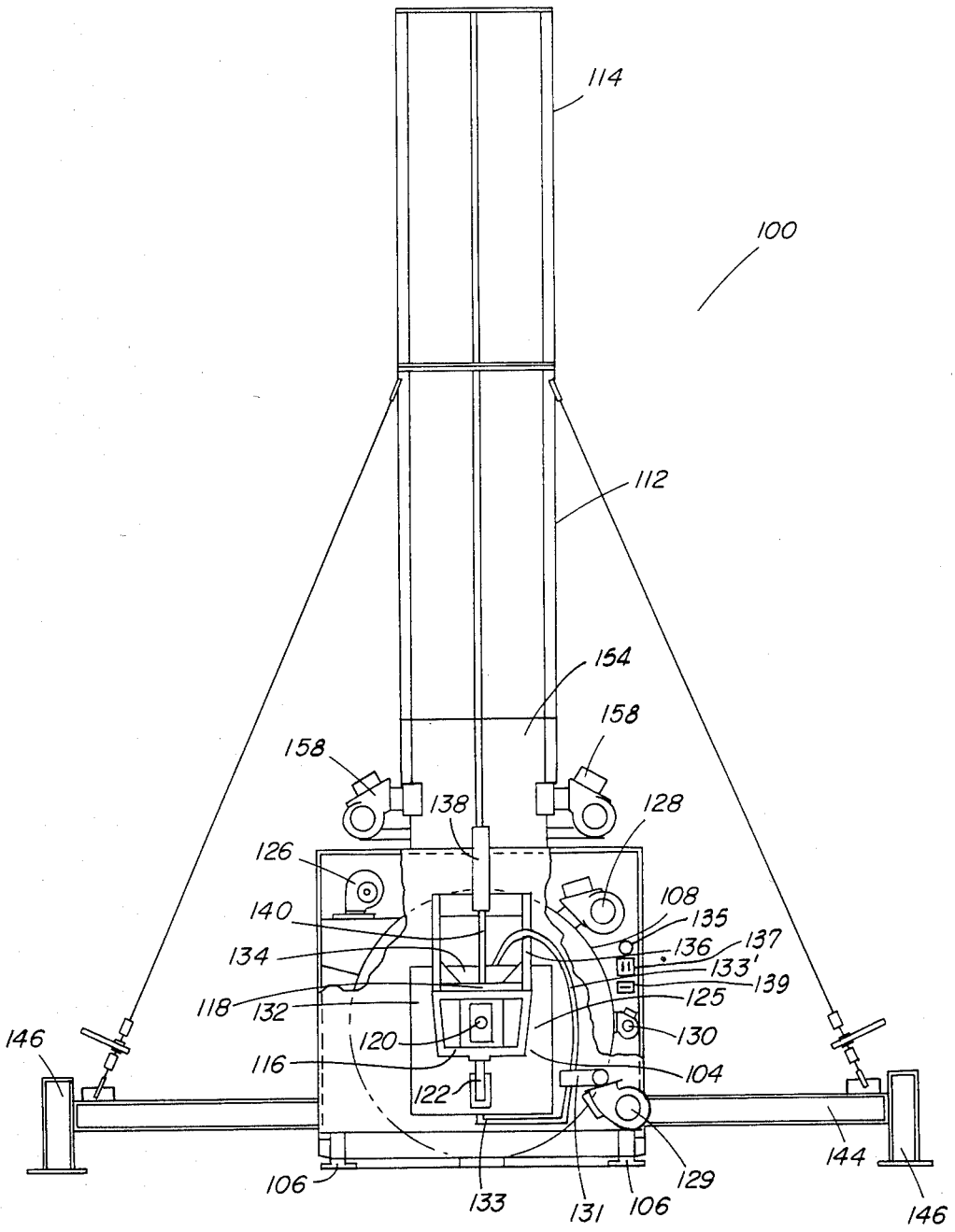
FIG. 4 is an end view of the incinerator of the present invention.

Referring to FIG. 4, the other end of the incinerator 100, having the ram type feeder 104 is shown having the control panel 102 deleted from the incinerator for clarity. The ram type feeder 104 comprises chamber or hopper 116 having door 118 opening thereinto and having ram assembly 120 secured to one end thereof. The ram type feeder 104 is secured to one end of the primary combustion chamber 108 having reinforcing means 122 secured thereto.

The movable door assembly 125 to the incinerator 100 generally comprises an air cooled rectangular box-like lower housing 132 having guide means therein for door 134 therein controlling the entry to the primary combustion chamber 108, rectangular box-like upper housing 136 which receives the door 134 therein when door 134 is in its raised position and pneumatic cylinder means 138 secured to the upper housing 136 having the cylinder rod 140 connected to the door 134 to actuate the same. The box-like lower housing 132 and door 134 is internally air cooled by directing cooling air from blower 129 through manifold 131 connected to the lower housing 132 via line 133 and connected to the door 134 also via line 133.

The incinerator 100 further includes water spray manifolds in the interior of the incinerator in the front portion thereof (not shown) which are fed through lines from auxiliary power skid 300. Water will be injected automatically in case of overheating or pilot burner 130 flameout. Manual injection is used to control any excess charging heat load or smoking.

Further shown in FIG. 4 are viewport 135 to view the combustion process within incinerator 100, ram and door lift control assembly 137, and water spray manifold valve 139.

Figure 5:
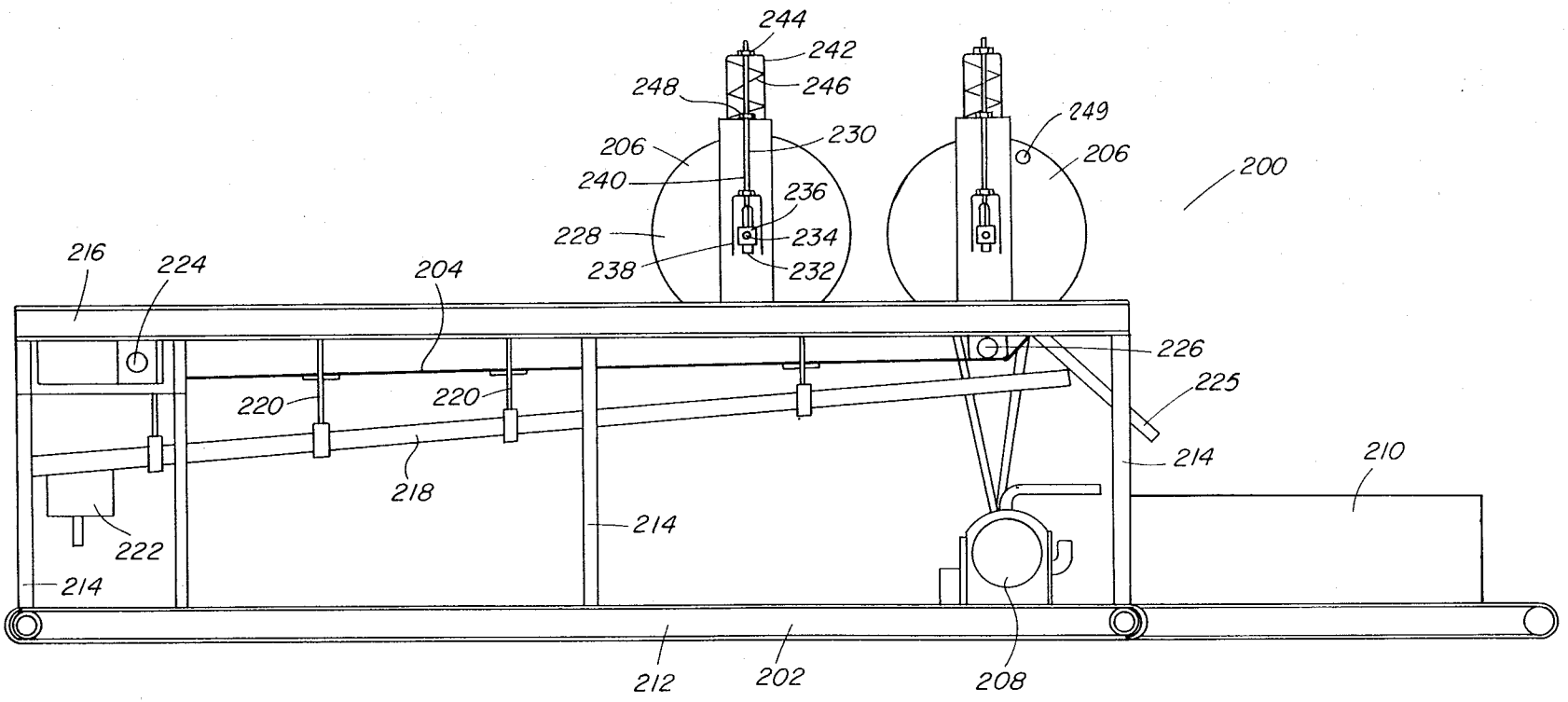
FIG. 5 is a side view of the wringer of the present invention.

Referring to FIG. 5, the wringer 200 of the present invention is shown. The wringer 200 comprises elongated rectangular frame 202, porous belt conveyor 204, resiliently mounted rollers 206, drive motor 208 and pad collection tank 210.

The elongated rectangular frame 202 comprises longitudinal base members 212 interconnected by suitable cross members (not shown), vertical members 214, longitudinal top members 216 interconnected by suitable cross members (not shown), V-shaped oil transfer tray 218 which is suspended by means of supports 220 from longitudinal top members 216 and has oil sump 222 at one end thereof and pad scraper means 225 which scrapes the oil or hydrocarbon soaked sorbent pads from specially sized porous belt conveyor 204.

The porous belt conveyor 204 comprises any suitable porous conveyor means which is capable of supporting oil or hydrocarbon soaked sorbent pads thereon, and which cannot permit pads to be mashed into the pores permanently after travel beneath the rollers 206 which squeeze most of the oil or hydrocarbons therefrom the pads allowing the oil or hydrocarbons to flow through the conveyor 204 onto the V-shaped oil transfer tray 218. The porous belt conveyor 204 is supported by the longitudinal top members 216 and the suitable cross members therebetween and is further supported by supports 220. The porous belt conveyor 204 rotates about adjustable roller assembly 224 and powered roller assembly 226.

Each resiliently mounted, water-fillable, roller 206 comprises a cylindrical roller means 228 retained within a U-shaped rectangular frame 230 having an opening 232 in each side therein for the axle 234 of the roller means 228 to protrude therethrough. The ends of axles 234 of the roller means 228 are retained within bearing blocks 236 which are slidably received within frame assembly 238 mounted on the sides of rectangular frame 230. A rod 240 is secured to each bearing block 236 and extends upwardly through the top portion of frame 238 into spring retainer frame 242 located on the top of the U-shaped rectangular frame 230. The spring retainer frame 242 receives the end portion of the rod 240 allowing the end thereof to protrude from the top thereof having threaded or suitable adjustable fastening means 244 thereon. Contained within spring retainer frame 242 is spring 246 and spring stop 248 secured to rod 240 thereby retaining the spring 246 in adjustable engagement with the top of the spring retainer frame 242. By adjusting the relative positions of fastening means 244 and spring stop 248 on rod 240 with respect to spring retainer frame 242 the amount of force required to move axle 234 of the roller means 228 within the opening 232 of the U-shaped rectangular frame 230 may be adjusted and the amount of travel of the axle 234 within the opening 232 may be adjusted. Water can be placed within the rollers 206 through filler plug 249 to further control the squeezing forces within the roller and porous conveyor 204.

The drive motor 208 comprises any suitable drive means capable of driving the porous belt conveyor 204, such as a hydraulic motor, electric motor, air operated motor, etc. The drive motor 208 is connected to the porous belt conveyor 204 by any suitable drive means, such as a chain and sprocket drive, belt and pulley drive, etc.

Different porous belts 204 can be selected for various sorbent material pads available from various manufacturers.

The pad collection tank 210 comprises a rectangular tank installed at one end of the wringer 200 to receive the pads after they have passed beneath rollers 206 and have been scraped from the porous belt conveyor 204 by pad scraper 225.

Figure 6:
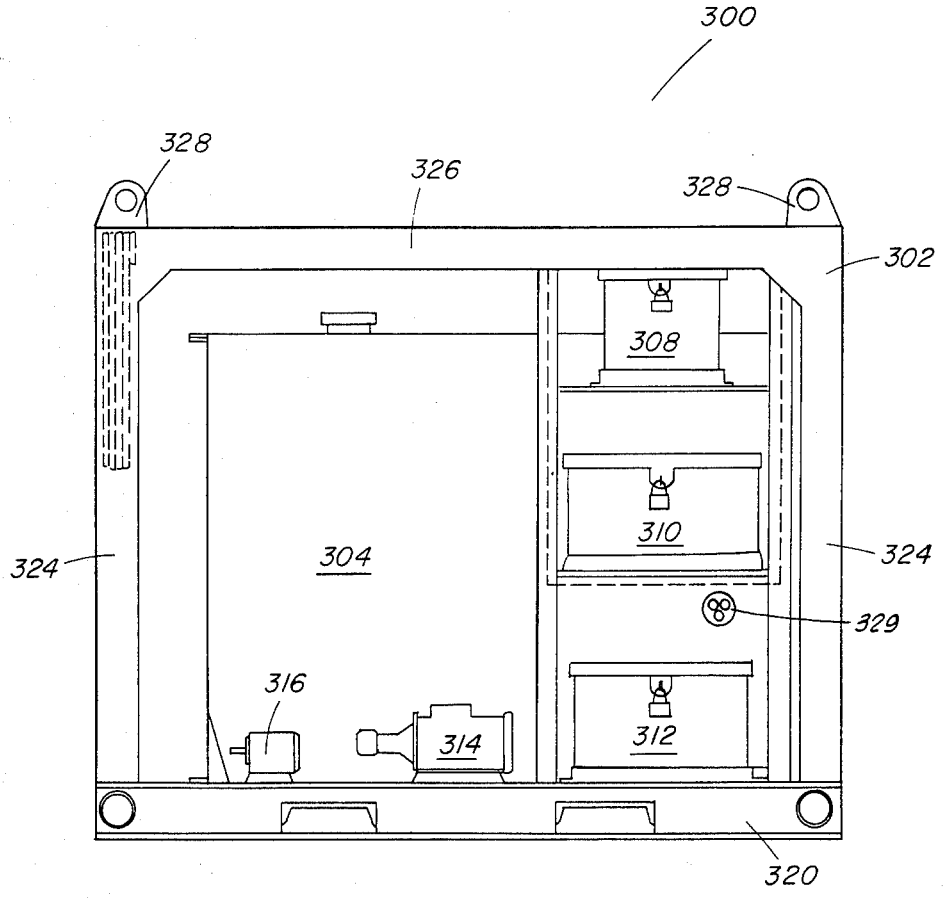
FIG. 6 is a side view of the auxiliary skid of the present invention.

Referring to FIG. 6, the right side of the auxiliary power skid 300 is shown. The auxiliary power skid 300 comprises frame 302, fuel tank assembly 304, fire extinguisher assembly 306 (see FIG. 7), wiring assembly 308, battery charger and power inverter assembly 310, battery power assembly 312, auxiliary power connection 329 from 331 (see FIG. 9), water pump assembly 314, fuel pump assembly 316, and water tank assembly 318 (see FIG. 7).

The frame 302 which forms the extremities of the auxiliary power skid 300 and contains the various components therein comprises base frame 320 having suitable openings 322 therein for lifting purposes, vertical frame posts 324, and top frame 326 having lifting means 328 thereon.

Figure 7:
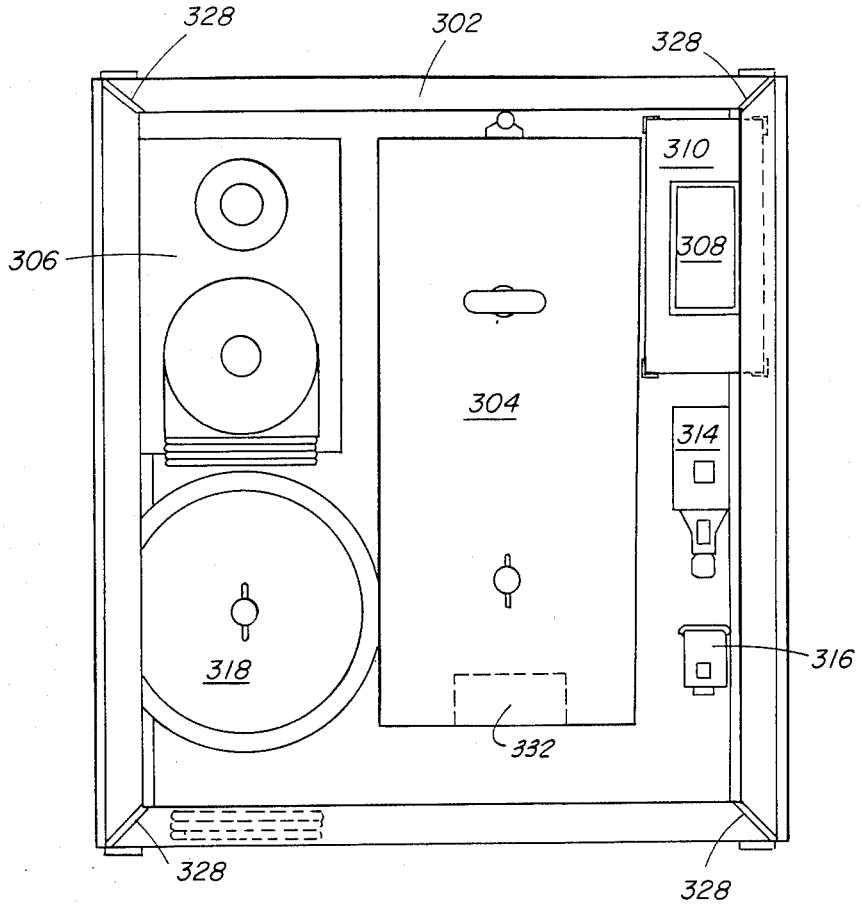
FIG. 7 is a top view of the auxiliary skid of the present invention.

Referring to FIG. 7, the auxiliary power skid 300 is shown in planform. As shown, the fuel tank 304 is approximately centrally located within the skid. An alarm activator 332 is located in the fuel tank to warn of a low fuel condition. The water tank 318 and fire extinguishing means 306 are located on the left side thereof.

Figure 8:
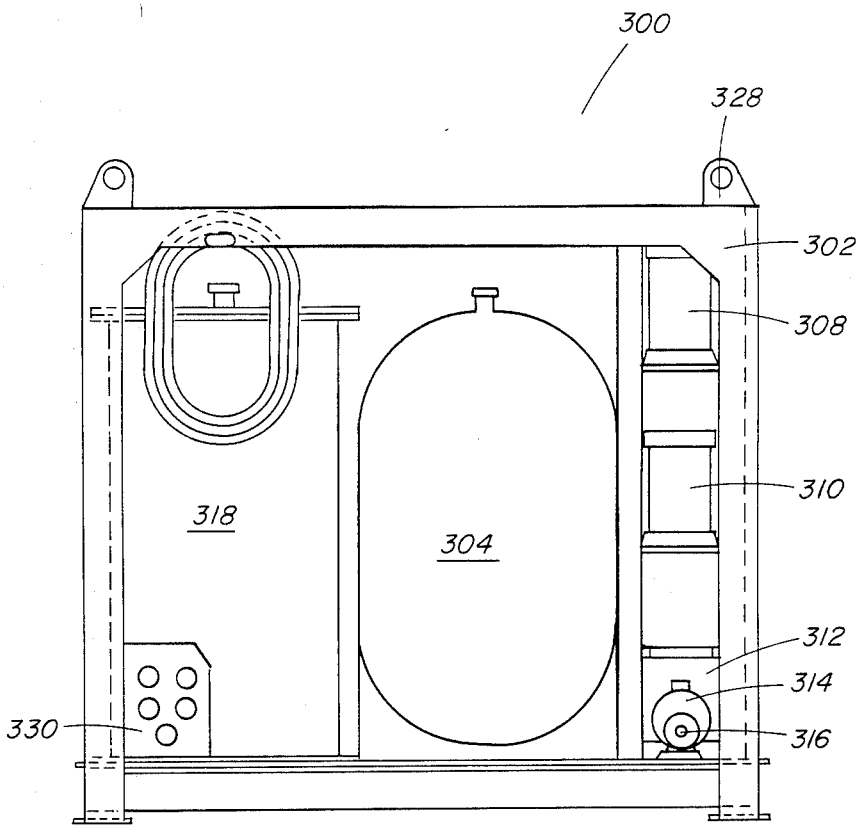
FIG. 8 is an end view of the auxiliary skid of the present invention.

Referring to FIG. 8, the front of the auxiliary power skid 300 is shown. A central connection panel 330 for all electrical and fluid connections is included on the front of the skid 300 for convenience during operation and assembly of the incinerator system 10.

As apparent from FIGS. 6, 7 and 8 the auxiliary power skid 300 is utilized to supply the necessary auxiliary electrical power, in case of main generator failure, and water and fuel to the incinerator system 10 for the normal operations thereof.

Figure 9:
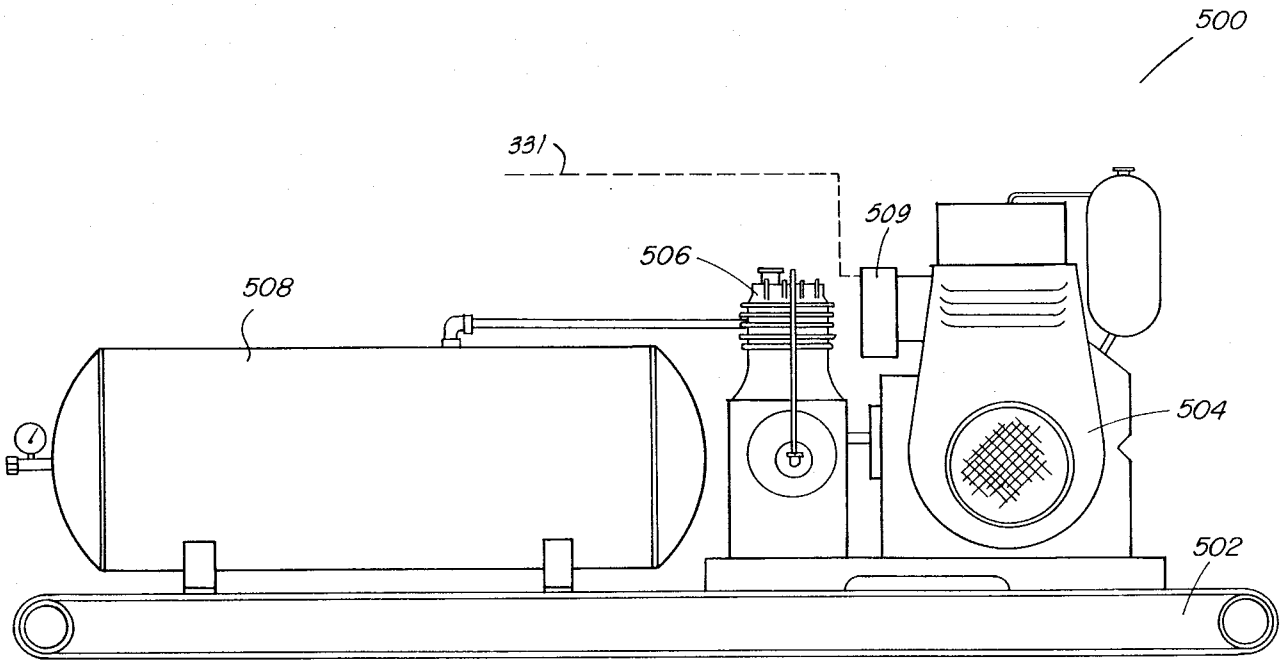
FIG. 9 is a side view of the air compressor skid of the present invention.

Referring to FIG. 9, a typical air compressor unit 500 is shown. The air compressor unit 500 comprises frame 502, engine 504, air compressor 506 and tank 508. The air compressor unit may be of any desired size as long as it is capable of supplying the necessary volume and pressure of compressed air to operate the motor 208 on the wringer 200, if an air operated motor is utilized, and the rams 120 and 138 on the ram feeder 116 of the incinerator 100, if air operated cylinders are utilized on the ram feeder 116. An auxiliary generator 509 or alternator can supply power through cable 331 to the auxiliary skid connection 329.

If no compressed air source is required, but rather a source of hydraulic power is required to operate the motor 208 on the wringer 200 and rams 120 and 138 on the ram feeder 116, the air compressor unit 500 may be deleted and a hydraulic fluid supply unit may be utilized.

Figure 10:
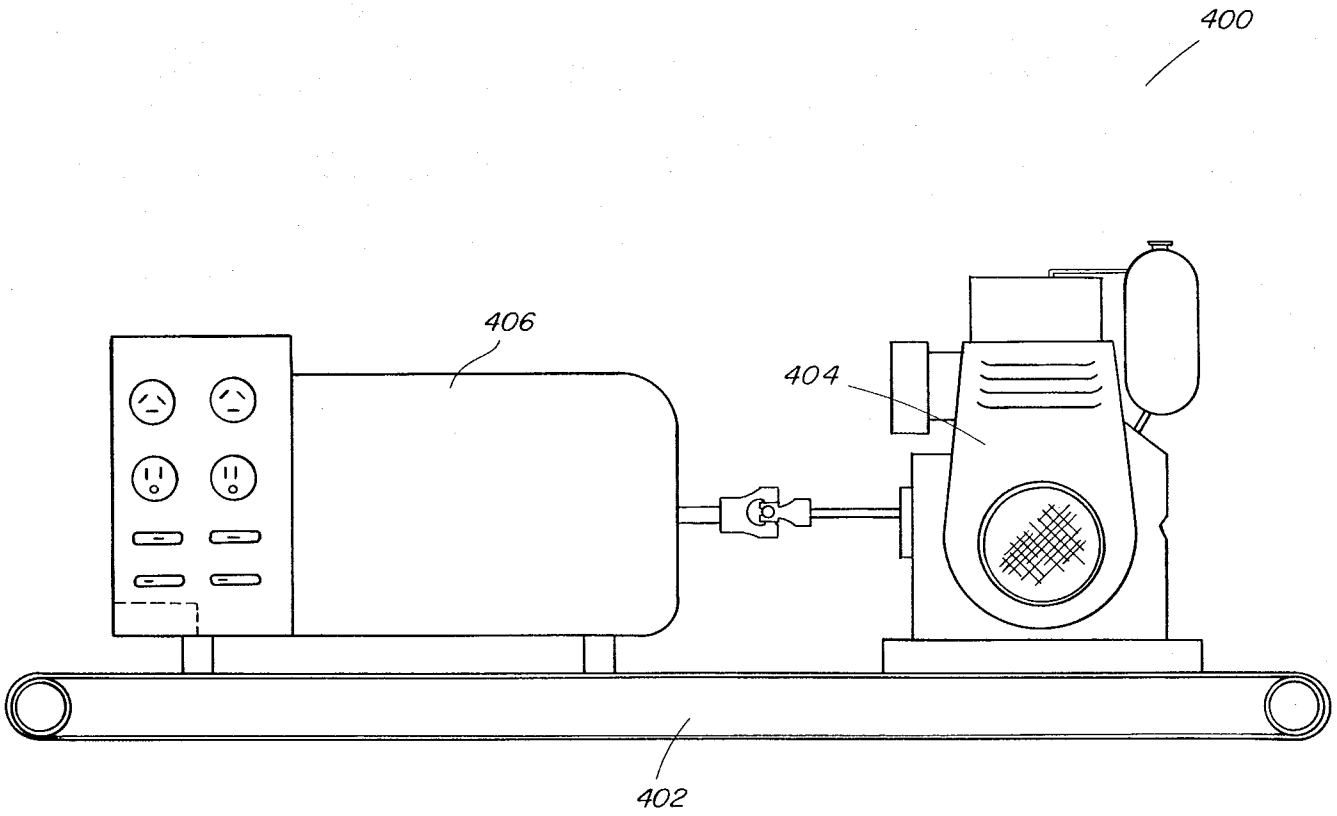
FIG. 10 is a side view of the generator skid of the present invention.

Referring to FIG. 10, a typical generator unit 400 is shown. The generator unit 400 comprises a frame 402, motor 404 and generator 406. The generator unit 400 may be of any convenient size so long as it is capable of supplying the necessary electrical power to operate the incinerator system 10. An alarm system within the central panel 102 is activated in case of main generator failure in which case the auxiliary skid 300 supplies power automatically.

OPERATION OF THE SYSTEM

Referring to FIG. 1, the operation of the incinerator system 10 will be described.

The incinerator system 10 is transported to the incineration site aboard a truck, barge, or other suitable transportation.

The incinerator system 10 is removed from the truck and arranged in any convenient configuration so long as the pad collection tank 210 is conveniently located with respect to the ram feeder 104 of the incinerator 100 to allow the ready transfer of pads from the pad collection tank 210 to the feeder 104.

To start the incineration system 10 the generator 400 and air compressor 500 are started to supply power to the incinerator system 10.

The fuel pump 316 on the auxiliary power skid 300 is started to supply fuel to the main oil fired burners 128 and 158. The pilot burner 130 is typically gravity or suction supplied with fuel to avoid the flameout thereof in case of a fuel pump motor failure. At this time, the combustion air blowers 126 start to purge the primary combustion chamber 108 before the ignition of the pilot burner 130 and main oil fired burners 128. After purging of the primary combustion chamber 108 has been accomplished, the pilot burner 130 and main oil fired burners 128 and 158 are ignited to preheat the primary combustion chamber 108 to a pre-set control temperature, usually approximately 1300 to 1400 degrees Fahrenheit. When the primary combustion chamber 108 has reached the desired pre-set control temperature, material may be placed into the ram feeder 104 and fed into the chamber 108 for incineration, and to further increase the temperature to over 1500° F. Typically, burning is soon self-sustaining, and the temperature in the primary combustion chamber 108 ranges between 1600° to 1900° F. during the charge periods. The upper temperature limit is restricted by not overcharging the ram the prescribed tested amount; and the lower limit is maintained by the frequency of charging.

If excessive smoke or particulate emission were momentarily present during the incineration process, it is probably due to overloading of the primary combustion chamber 108 and/or the presence of excessively low flash point hydrocarbons. Such emissions may be controlled by activating the water spray manifold using water spray manifold valve 139 in the primary combustion chamber 108 to lower the operating temperature and the supply of oxygen within the chamber 108 or by utilizing one or both of the oil fired burners 158 in the reactor section 110.

Somewhat similarly, if material to be incinerated sticks to the door 134 of the ram feeder 104, this indicates an excessive exterior temperature of the door. To remedy this excessive temperature condition, the water spray manifolds in the primary combustion chamber 108 may be utilized to lower the door temperature.

Lights on the control panels indicate the on-off condition of all utilities and operational stages.

Having thus described my invention, I claim:

1. A movable incineration system for the disposal of sorbent pads used in the cleanup of spills of hydrocarbons comprising:

an incinerator for incinerating said sorbent pads therein, the incinerator including:

a ram type feeder thereon for feeding said sorbent pads into the primary combustion chamber of the incinerator; and a reactor section connected to the primary combustion chamber of the incinerator;

a wringer for partially removing said hydrocarbons from said pads before the incineration thereof, the wringer comprising:

a frame;

a porous belt conveyor mounted on the frame;

a resiliently mounted roller on the frame in contact with the porous belt conveyor; and a drive motor connected to the porous belt conveyor;

a generator for providing electrical power to the incinerator;

an air compressor for providing compressed air to the incinerator; and an auxiliary power skid unit for providing at least electrical power to the incinerator upon the cessation thereof from the generator, the auxiliary power skid unit comprising:

a frame;

a fuel tank assembly mounted on the frame;

a fire extinguisher assembly mounted on the frame;

a battery power assembly;

a battery charger for charging the battery power assembly;

a power inverter assembly for converting direct current to alternating current;

a fuel pump assembly; and a water tank assembly.

2. The movable incinerator assembly of claim 1 wherein the wringer further includes:

a pad collection tank to receive said sorbent pads.

3. The movable incinerator assembly of claim 2 wherein the ram type feeder on the incinerator is operated from a source of compressed air.

* * * * *